United States Patent [19]

Scripps

[11] Patent Number: 4,694,285

[45] Date of Patent: Sep. 15, 1987

[54] COMBINATION ELECTRICAL LIGHT, SMOKE AND/OR HEAT DETECTOR

[76] Inventor: Keith A. Scripps, 4301 Massachusetts Ave., NW., Washington, D.C. 20016

[21] Appl. No.: 797,008

[22] Filed: Nov. 12, 1985

[51] Int. Cl.[4] ..... G08B 23/00

[52] U.S. Cl. ..... 340/693; 340/628; 340/691; 340/586

[58] Field of Search ..... 340/693, 628, 691, 584, 340/586, 517

[56] References Cited

U.S. PATENT DOCUMENTS

| | | | |
|---|---|---|---|
| 4,090,178 | 5/1978 | Norris | 340/628 |
| 4,093,943 | 6/1978 | Knight | 340/693 |
| 4,255,746 | 3/1981 | Johnson et al. | 340/584 |
| 4,319,229 | 3/1982 | Kirkor | 340/517 |
| 4,365,237 | 12/1982 | Knight | 340/596 |

*Primary Examiner*—Donnie L. Crosland

*Attorney, Agent, or Firm*—John G. Semmes

[57] ABSTRACT

The combination is described of an electrical smoke, heat detector and electrical light in a single unit which is removably attachable to an electrical fixture. The combination includes a closed housing containing smoke heat sensing alarms. Also recessed flush within the housing is a light bulb socket for reception of a light bulb into a face of the housing. Protruding from an opposite face of the housing is an electrical connector, capable of screw-in attachment to a standard electrical outlet fixture. A switching device to turn the light on or off, forms of which include: push button, toggle switch, or pull chain, is installed within the closed housing such that the switch is operable externally of the housing. A second switching device, also operable externally of the housing activates and de-activates a self-contained battery power source to operate the smoke and heat sensor functions of the combination.

2 Claims, 2 Drawing Figures

COMBINATION ELECTRICAL LIGHT, SMOKE AND/OR HEAT DETECTOR

BACKGROUND OF THE INVENTION AND DESCRIPTION OF PRIOR ART

The invention encompasses existing smoke sensing and/or heat alarming techniques and combines said knowledge with related illumination technology to produce an inventive result. The invention eliminates the need for special electrical wiring or batteries associated with current smoke and/or heat detectors in that it will screw into a pre-existing light fixture and thus utilize standard household electrical current. Although the present invention does utilize a battery circuit, said battery system is to be used as a backup power source to the primary 120 Volt AC power from the fixture. A further useful result of the invention is that its installation method obviates the necessity of creating holes for screws or other fasteners associated with the present smoke and/or heat detectors.

The prior art discloses several inventions which combine various functions such as smoke detection, stereophonic radio, intrusion sensing, and power failure sensing with an illumination system. None of the inventions, however, teach or suggest the solutions to the inconveniences of utilizing special permanent mounting hardware and electrical wiring and/or battery replacement, hereby eliminated by the present invention. The invention solves these problems while retaining the essential concurrent functions of the heat and/or smoke detecting and lighting systems. When installed the smoke and/or heat detector unit will be disposed flush or nearly flush against the mounting surface. In addition, as many pre-existing ceiling light fixtures are located in the center of the ceiling, the smoke detector unit incorporated in this invention will be installed in the location suggested for optimal smoke detection and alarm performance. Reference: FIRST ALERT OWNER'S MANUAL, Model SA1839, Rev. 2/85.

Relevant prior art is fully disclosed by these cited patents:

(A) Weber; U.S. Pat. No. 4,528,620; July 9, 1985;
(B) Knight; U.S. Pat. No. 4,365,237; Dec. 21, 1982;
(C) Russ; U.S. Pat. No. 4,276,542; June 30, 1981;
(D) Raber; U.S. Pat. No. 4,227,191; Oct. 7, 1981;
(E) Johnson, et al.; U.S. Pat. No. 4,199,754; Apr. 22, 1980;
(F) Norris; U.S. Pat. No. 4,090,178; May 16, 1978;
(G) Podamy; U.S. Pat. No. 4,074,245; Feb. 14, 1978.

SUMMARY OF THE INVENTION

The invention embodies the electrical and structural integration of a smoke detector and/or heat sensor unit and an illumination unit with the useful ability of being simply and removably instalable into pre-existing light fixtures. Thus this combined and alternately selectible heat and smoke detector and light fixture provides portable and removable smoke and/or heat detection without structural modification or the sacrifice of pre-existing illumination. The result is basically achieved by the structural and electrical incorporation of a combination light socket and connector into the housing and interior components of a smoke and/or heat detector unit. The invention comprises a closed housing containing smoke and/or heat sensor and alarm equipment together with a light socket and switching mechanism. The switch is operable from outside of the housing.

The invention is electrically wired whereby the electrically powered smoke and/or heat detector is always "on" or sensing while the unit is installed in an existing electrical socket. An alternate self-contained electrical storage battery may power the smoke and/or heat sensor and alarm portion of the invention. The battery circuit is automatically activated by a switching mechanism, consisting of a relay or diodes.

A light bulb or any other related device secures into the recessed socket in the unit and protrudes perpendicular to a facing of the housing. On the opposite side of the housing there protrudes an electrical connector that is the other end of the single molded piece which also comprises the light socket. Said connector is electrically attached to the light socket and smoke and/or heat detector unit. Once secured into an electrical fixture, the connector both mounts the invention in fixed position and routes electric current from the fixture to both the smoke and/or heat detector and the light socket and bulb. Thus once installed in a "live" electrical ceiling fixture, the invention functions as both an optimally positioned smoke and/or heat detector and a switchable light.

DETAIL OF THE PREFERRED EMBODIMENTS

The invention, a combined and alternately selectible heat and smoke detector and light fixture is best described by reference to the drawings.

Figure 1:
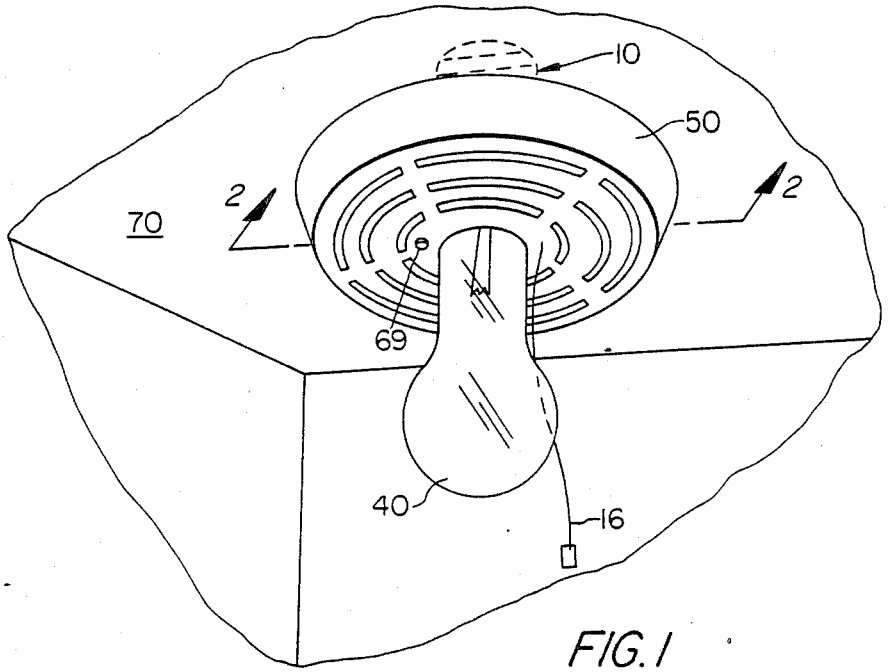
FIG. 1 is an isometric view of the installed invention as viewed from below.
Figure 2:
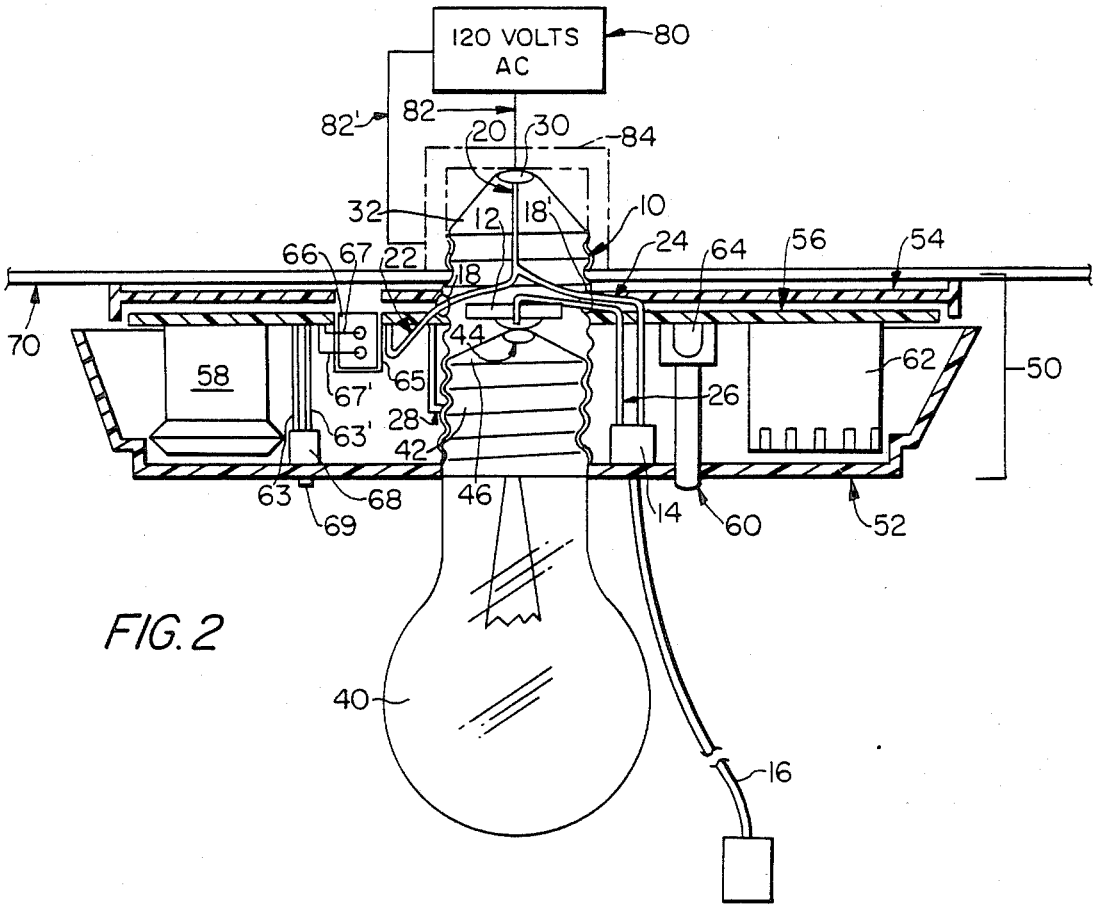
FIG. 2 is a side elevation section view of the invention taken along line 2—2 of FIG. 1.

FIG. 1 illustrates the preferred configuration of the invention, installed in a typical electrical fixture which may be located within a building structure. Light bulb 40 projects straight downward perpendicular to the overhead or ceiling 70 and smoke and/or heat detector 50. The vertical dimensions of the electrical connector portion of the socket and connector assembly 10, the base 54 and the shroud of the smoke detector grille cover 52 may be varied to achieve optimal mounting of the invention with the ceiling 70 in all installations, regardless of the configuration of the particular fixture 84, reference FIG. 2.

The preferred power source 80 for the invention is operably the standard household electrical current of 120 Volts AC. With minor conventional changes, the invention is adaptable to alternate power sources; such modifications being well-known to those skilled in the art. The power is delivered to the invention from power source 80 via conducting wires 82,82' to a fixture 84. Said arrangement is typically previously installed in place in most residences and commercial buildings.

The connector portion of the connector and socket assembly 10 may preferrably be screwed into the fixture 84. This will not only electrically interconnect the invention with the power source, but also structurally attach the invention to the fixture. Said invention may thus be easily removed and/or reinstalled.

Once installed, current passes in a first circuit through the connector and socket 10 through fixture contact 30 and the conductive cylindrical side of the assembly 10 itself. Insulation cone 32 separates the two conductive surfaces. Wire 20 electrically connects the fixture contact with wires 22,24. Wire 22 is attached to a doughnut-shaped circuit board 56 of the smoke and/or heat detector while wire 24 is attached to switch 14. The circuit to the smoke and/or heat detector unit is completed by wire 28 connecting the circuit board with the conductive side of the connector/socket assembly 10.

The second circuit involves the lighting function of the invention. From switch 14 wire 26 connects to bulb socket contact 12. Light bulb 40 is screwed into the socket end of connector/socket assembly 10 until bulb contact 44 registers with the socket contact. When switch 14 is closed via pull chain 16 or alternate device the electrical circuit is complete with current flowing to the bulb through contacts 42 and 44 which are electrically separated by the bulb's insulation cone 46. Socket contact 12 may be held in place by an insulation in-fill, preferably of silicon, thus filling the interior of the connector portion of assembly 10. Wires 22,24 and 26 are routed in and out of the interior of the cylindrical assembly 10 via electrically insulated holes 18,18'.

The major smoke and/or heat detecting components of the interior of the invention 50 within grille cover 52 include the alarm horn 58, smoke and/or heat sensor 62, clear plastic test button 60 and LED (light emitting diode) pilot light 64. Said components may be conveniently spatially arranged about assembly 10 and switch 14 on a circuit board 56 as typically shown in FIG. 2. Preferably the circuit board is cut to fit around assembly 10.

A battery circuit is also incorporated into the invention to alternately power the smoke and/or heat detector. Battery 66 (a typical nine volt rechargeable battery and a conventional battery charger (not shown)) rests within a trough 65; access for installation and removal of the battery is from the back of the detector/light unit through openings in the base 54 and circuit board 56. Wires 67,67' electrically connect the battery terminals to the circuit board. A conventional electrical automatic switching device (not shown); is operably connected to the circuit board 56; thus interconnected to the electrical circuit the switching device will automatically energize and de-energize the battery circuit as the power source for the smoke and/or heat sensor. Said energization of the battery circuit will activate the battery as the power source for the smoke and/or heat detector unit if the 120 Volt AC power source is not present. If the 120 Volt AC power source is connected, then the battery circuit will be at the status of the standby power source to automatically activate upon loss of 120 Volt AC power. Said battery charger is electrically interconnected between 120 Volt AC power source and the battery 66 as to provide the battery with recharging current during normal 120 Volt AC operation of the invention.

Having fully described the invention, the claims are as follows:

I claim:

1. A combined and alternately selectible heat, smoke detector and electric light source for removable installation to an electric fixture comprising;

(A) electrically operable, combined smoke and heat sensor and alarm therefor, each being interconnected to the other;

(B) at least one illumination receptacle switchedly electrically interconnected to the smoke and heat sensor and alarm said illumination receptacle being recessed within the detector;

(C) connector electrically interconnected to said combined smoke and heat sensor and alarm therefor and to said receptacle in extension thereof; said connector being affixed to the smoke and heat sensor and alarm adjacently and in opposite orientation thereto in an integrated structure;

(D) a light source contained by the receptacle;

(E) an electrical power source for the elements aforesaid and wherein switching means is incorporated to energize and de-energize the power source.

2. The combined and alternately selectible heat and smoke detector and light fixture of claim 1 wherein the self-contained power source is recharged by a self-contained battery charger powered by an external power source.

* * * * *